United States Patent [19]

Murray

[11] 4,346,496

[45] Aug. 31, 1982

[54] FOLDABLE IMPLEMENT

[76] Inventor: Michael L. Murray, P.O. Box 223, Ft. Collins, Colo. 80522

[21] Appl. No.: 271,782

[22] Filed: Jun. 8, 1981

[51] Int. Cl.[3] ..... A46B 7/00; A46B 9/02

[52] U.S. Cl. ..... 15/185; 15/203; 132/121; 132/76.2; 51/392

[58] Field of Search ..... 15/184, 185, 201, 202, 15/203; 132/120, 121, 75.6, 76.2, 85; 81/177 E; 30/153; 51/391, 392, 393; D4/17

[56] References Cited

U.S. PATENT DOCUMENTS

| | | | |
|---|---|---|---|
| 1,063,411 | 6/1913 | Brüpbacher | 15/185 |
| 1,549,545 | 8/1925 | Hickman | 30/153 |
| 3,967,338 | 7/1976 | Russell | 15/185 |
| 4,057,867 | 11/1977 | Ballin | 15/185 |

*Primary Examiner*—Peter Feldman
*Attorney, Agent, or Firm*—Hugh H. Drake

[57] ABSTRACT

An implement includes first and second elongated legs that are joined by a first hinge between respective one ends thereof to permit those legs to be folded toward and away from one another. The legs are mutually shaped to define a cavity within a handle when folded together about the hinge. Third and fourth elongated legs are each of a size to be nested within the portion of the cavity defined by a respective one of the first and second legs. A second hinge couples one end of the third leg to the other end of the first leg. A third hinge couples one end of the fourth leg to the other end of the second leg. Finally, a fourth hinge couples together the other ends of the third and fourth legs. The legs individually have respective different lengths to define a toggle movement of the third and fourth legs between a first stable position concealed within the cavity of the handle and a second position in which they project generally co-linearly away from the cavity and the first and second legs when the latter are folded together. Defined on at least one of the third and fourth legs and for performing a task, when those first and fourth legs project away from the cavity, is a working implement.

11 Claims, 24 Drawing Figures

FOLDABLE IMPLEMENT

The present invention pertains to a foldable implement. More particularly, it relates to an implement in which the working device may readily be stored in a concealed position within the handle and yet at any time be easily projected outwardly beyond the handle of the implement.

It is known in the prior art to provide different implements with handles that are hinged to the implement in a manner to be swung around toward a secured storage position. U.S. Pat. Nos. 237,498—Deasey, 365,086—Miller and 1,659,418—Werner are examples. Other prior art has employed a quadrilateral structure for the purpose of defining an internal cavity within which an operative instrument, such as a cork screw, is confined during a condition of storage. Typical are U.S. Pat. Nos. 447,185—Hollweg, 1,549,545—Hickman and 2,482,348—Land.

In all of these cases, the working portion of the implement is a separate structure in the total assembly. That is, the ultimate portions of the device which constitute a concealing handle have been provided as separate parts in addition to the desired working structure.

It is, accordingly, a general object of the present invention to provide a foldable implement that permits folding as between storage and operative conditions and in which the working implement is an integral part of one or more of the basic elements.

Another object of the present invention is to provide a new and improved folding implement which is simple and more economical of fabrication and supply.

In accordance with the present invention, an implement includes first and second elongated legs joined by a first hinge between respective one ends thereof to permit those legs to be moved together and away from one another in rotation around the hinge. The legs are mutually shaped to define a cavity when folded together about the hinge. Third and fourth elongated legs each are of a size to nest within the portion of the cavity defined by a respective one of the first and second legs. A second hinge couples one end of the third leg to the other end of the first leg. A third hinge couples one end of the fourth leg to the other end of the second leg. Still a fourth hinge couples together the other ends of the third and fourth legs. The different legs individually have respective lengths permitting toggle movement of the third and fourth legs between a first stable position concealed within the cavity and a second position in which they project generally colinearally away from the cavity and the first and second legs when the latter are moved together. Means defined on at least one of the third and fourth legs are formed to carry out a task when those legs so project away from the cavity.

The features of the present invention which are believed to be patentable are set forth with particularity in the appended claims. The organization and manner of operation of the invention, together with further objects and advantages thereof, may best be understood by reference to the following description taken in connection with the accompanying drawings, in the several figures of which like reference numerals identify like elements, and in which:

Figure 1:
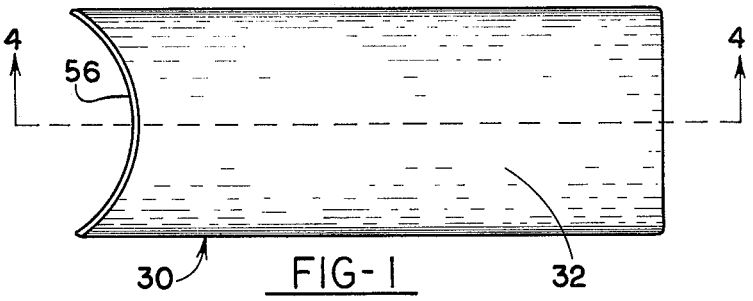
FIG. 1 is a top plan view of an implement assembly folded into a storage mode.
Figure 5:
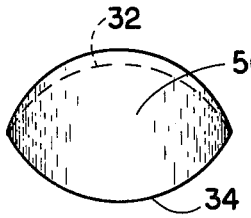
FIG. 5 is a left end elevational view of the assembly of FIGS. 1-3.
Figure 2:
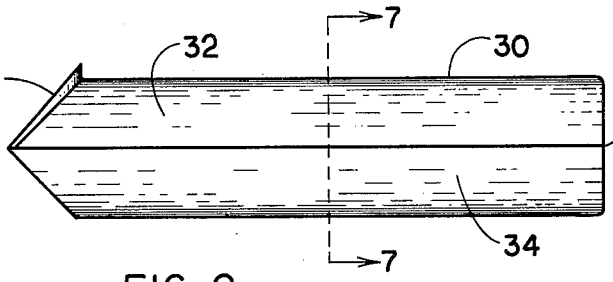
FIG. 2 is a side elevational view thereof.
Figure 6:
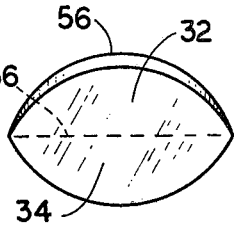
FIG. 6 is a right end elevational view thereof.
Figure 3:
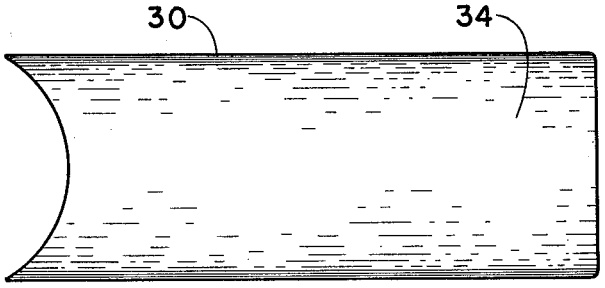
FIG. 3 is a bottom plan view thereof.
Figure 4:
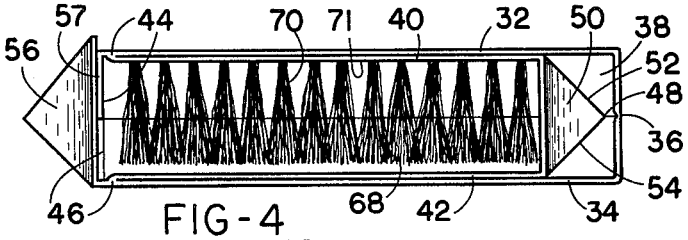
FIG. 4 is a cross-sectional view taken along the line 4—4 in FIG. 1.
Figure 7:
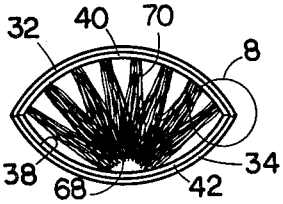
FIG. 7 is a cross-sectional view taken along the line 7—7 in FIG. 2.

As herein embodied for purposes of illustration, an implement 30 includes first and second elongated legs 32 and 34 joined by a first hinge 36 between respective lower ends thereof. Hinge 36 permits legs 32 and 34 to be moved toward and away from one another in rotation around hinge 36. Legs 32 and 34 are mutually shaped to define a cavity 38 when folded together about hinge 36.

Third and fourth elongated legs 40 and 42 are each of a size to nest within a portion of cavity 38 defined by the respective ones of legs 32 and 34. A second hinge 44 couples the outer end of leg 40 to a location neat the outer end of leg 32. A third hinge 46 similarly couples the outer end of leg 42 to a location near the outer end of leg 34. Finally, a fourth hinge 48 couples the outermost ends of legs 40 and 42.

Figure 17:
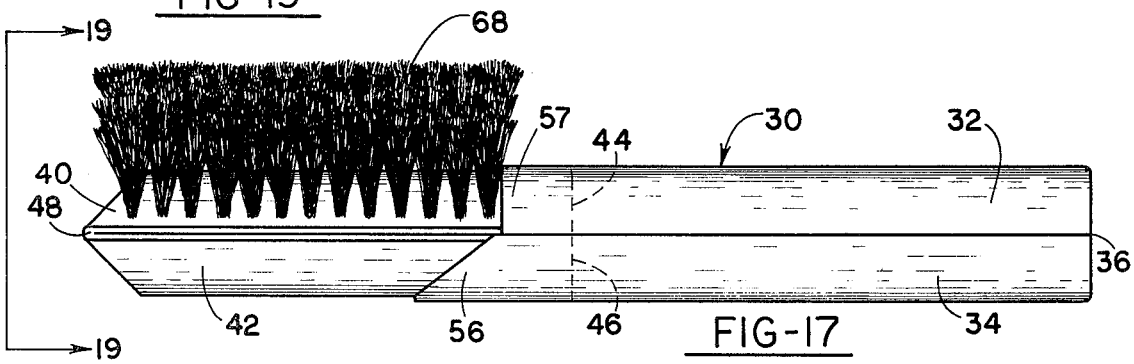
FIG. 17 is a side elevational view with the assembly fully closed into its utility mode.

The different ones of legs 32, 34 and 40, 42 individually have respective lengths so as to permit a toggle movement of legs 40 and 42. There is a first stable position, as shown in FIG. 1–4 and 9, in which legs 40 and 42 are concealed within cavity 38, and a second stable position, as shown in FIG. 17, in which legs 40 and 42 project away generally collinearly from cavity 38 while legs 32 and 34 again are folded together.

In the concealed position of FIGS. 1–4 and 9, it will be observed that inner legs 40 and 42 exhibit a cross-sectional shape which corresponds to the shape of legs 32 and 34. In the opened or use position, however, and as shown in FIG. 17, legs 40 and 42 again exhibit cross-sectional shapes which correspond to the shapes of legs 32 and 34. That is, legs 32 and 34 are of facing concave configurations. Legs 40 and 42 also each exhibit a concave lateral cross-section, and that occurs in both the open and closed modes of positioning of the different legs. During the toggle movement between the open and closed positions, each of legs 40 and 42 flexes about its longitudinal mid-portion and, thus, is able to assume a reverse mode of concavity. To that end, hinge 48 includes a flexible wall 50 that defines facing concave hinge lines 52 and 54 between wall 50 and respective ones of legs 40 and 42. Wall 50 exhibits a concave shape in each of the closed and open positions. However, it reverses its mode of concavity during the toggle movement between those two positions.

On the outer end of leg 34 is a flap 56. Flap 56 projects over a flap 57 on the outer end of leg 32 when legs 32 and 34 are in the position which represents the closed condition. Flap 56 is of concave configuration when the legs are positioned in either the open or closed, storage conditions. However, its mode of concavity reverses during the toggle movement of the legs between the open and closed conditions of use. This can be seen at the extreme limits by observing FIGS. 1–4, on the one hand, and FIG. 17, on the other. Flap 57 similarly changes in mode of concavity.

Figures 9, 10, 11, 12, 13, 14, 18:
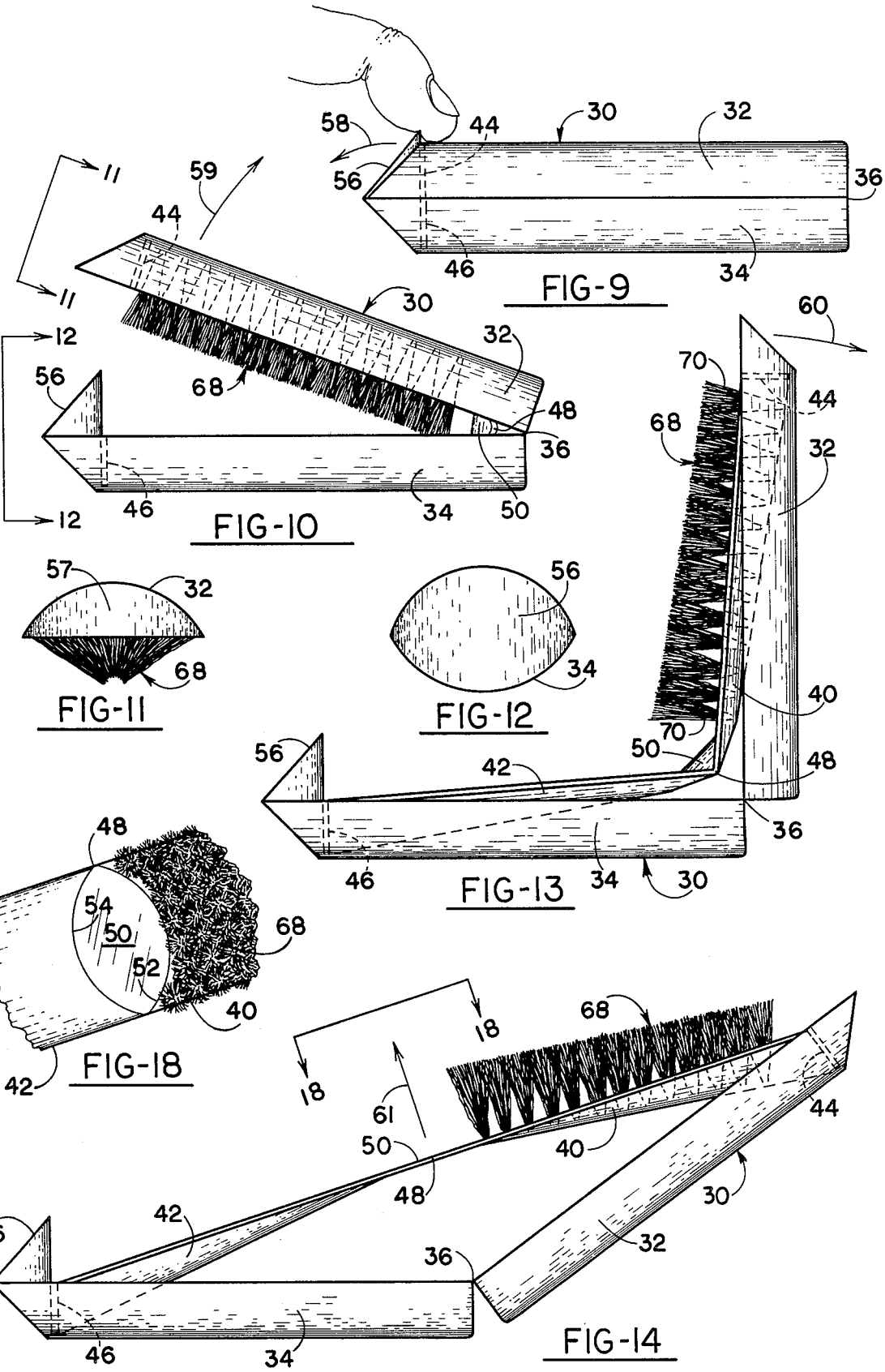
FIG. 9 is a view similar to FIG. 2 but showing the use of a finger to begin opening the assembly into its utility mode.
FIG. 10 is a side elevational view with the assembly slightly opened.
FIG. 11 is a left end elevational view taken along the line 11—11 in FIG. 10 and with the bottom portion of the assembly removed.
FIG. 12 is a left end elevational view taken along the line 12—12 in FIG. 10 and with the top portion of the assembly removed.
FIG. 13 is a side elevational view with the assembly opened further than in FIG. 10.
FIG. 14 is a side elevational view with the assembly open to its maximum extent.
FIG. 18 is a fragmentary plan-type view taken along the line 18—18 in FIG. 14 and with background components removed.
Figure 15:
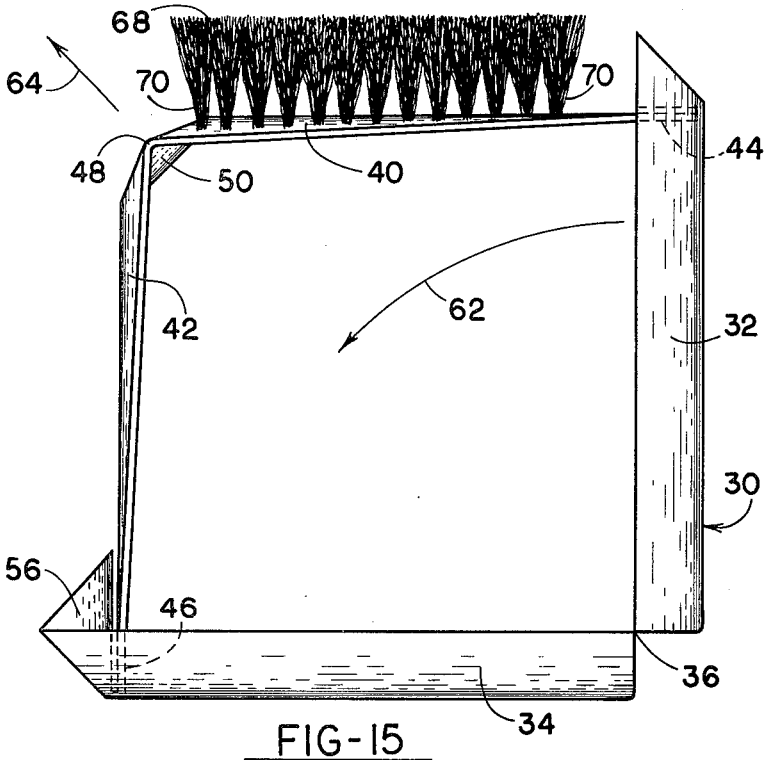
FIGS. 15 and 16 are side elevational views respectively showing the assembly in successively further degrees of movement toward closing in a utility mode.
Figure 16:
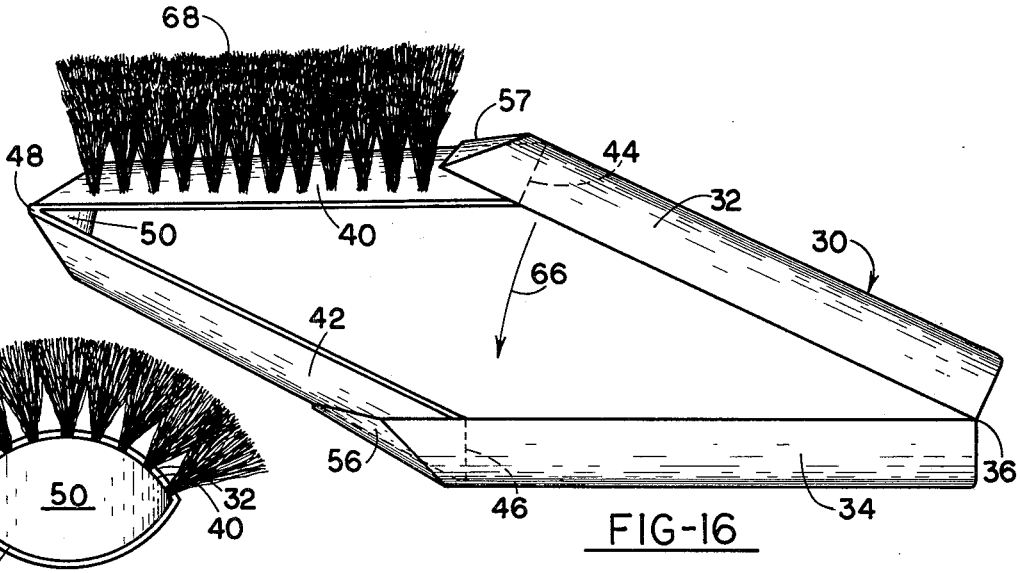
Figure 21:
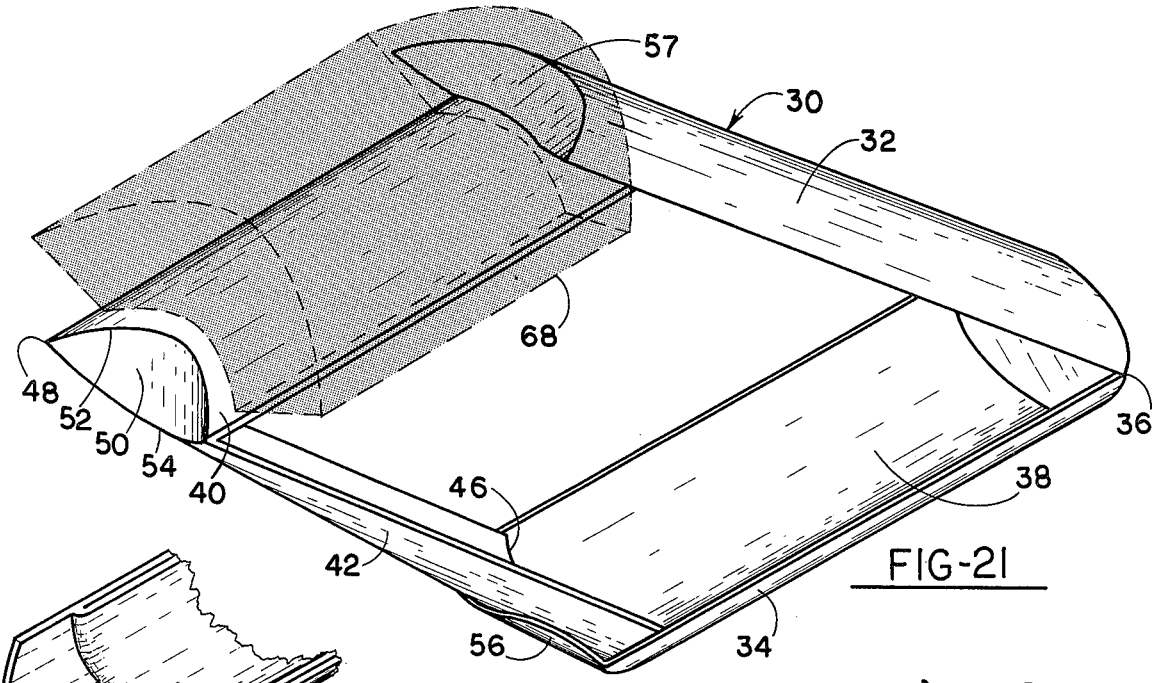
FIG. 21 is an isometric view of the assembly closing to its utility mode in approximately the amount of FIG. 16.
Figure 20:
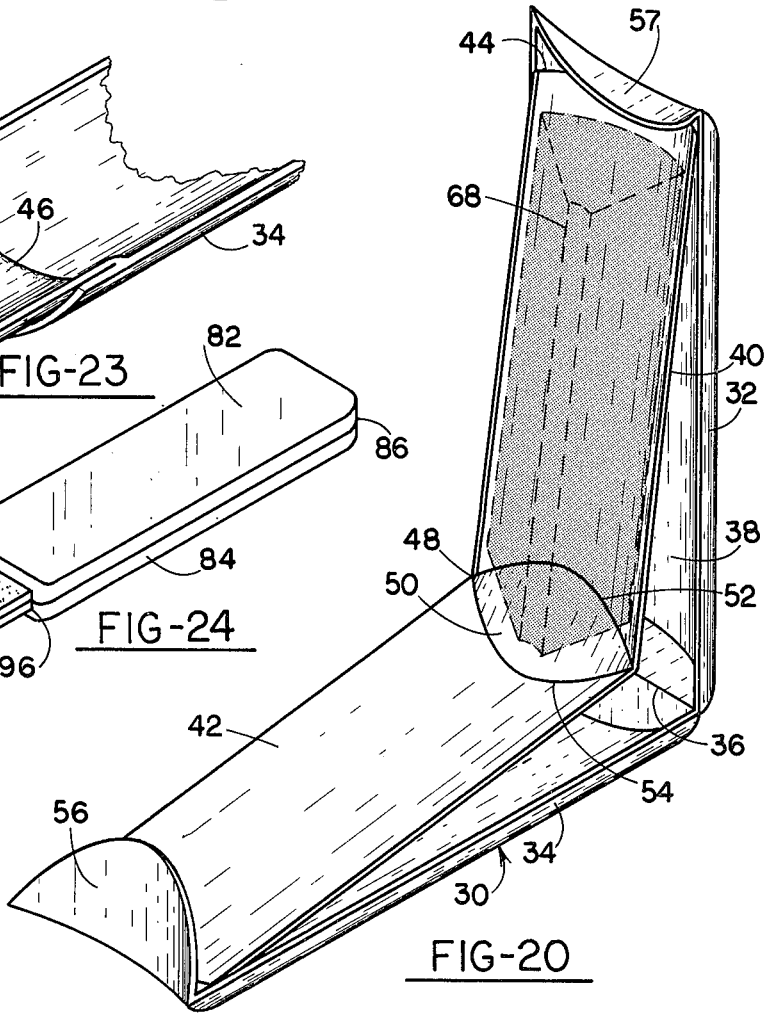
FIG. 20 is an isometric view of the assembly open in the amount of FIG. 13 and with but a schematic representation of clusters of bristles.

Operation can best be understood by considering FIGS. 9, 10, 13, 14, 15, 16 and 17 in order, noting also that FIG. 20 corresponds to FIG. 13 and FIG. 21 corresponds at least approximately to FIG. 16. Initially, flap 56 is pulled away as shown in FIG. 9 by arrow 58 to enable a spreading of legs 32 and 34 in a manner indicated by arrow 59 in FIG. 10 until the position of FIG. 13 is reached. At this point, legs 40 and 42 are still nested generally concentrically within legs 32 and 34, and wall 50 is flexed inwardly of the hinge at 48.

As legs 32 and 34 are pulled further apart, as indicated by arrow 60 in FIG. 13, to the position of FIG. 14, the curvature in wall 50 disappears and legs 40 and 42 move outwardly as indicated by arrow 61. Legs 32 and 34 next are swung in a direction back toward one another as indicated by arrow 62 in FIG. 15. This causes legs 40 and 42 to toggle on outwardly as indicated by arrow 64. At the same time, wall 50 has flexed into its reversed mode of concavity. With continued movement of legs 32 and 34 toward one another as indicated by arrow 66 in FIG. 16, the lower portion of leg 42 is urged against flap 56 and causes the latter to be flexed into its reverse mode of concavity as shown in FIG. 16. The same reversal occurs in flap 57. Finally, legs 32 and 34 are brought completely together as shown in FIG. 17. That also results in legs 40 and 42 aligning mutually together. The implement is then in a condition for use.

Figure 19:
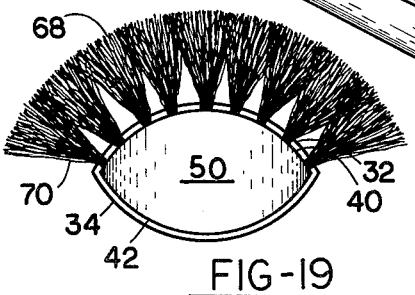
FIG. 19 is a left end elevational view taken along the line 19—19 in FIG. 17.

In the specific embodiment under discussion, the implement includes a brush composed of an array of bristles 68 arranged in a plurality of tufts 70. Bristles 68 are secured in leg 40 and project outwardly on the side of that leg that faces inwardly when the legs are in the closed or storage position. When the legs are in the storage position, the mode of concavity of leg 40 is in a direction that bristles 68 are squeezed together as shown in FIG. 11. When the toggle movement has been carried in the opening direction beyond the position of FIG. 14, however, the mode of concavity of leg 40 is reversed so that bristles 68 are spread apart as shown in FIG. 19.

As illustrated, bristles 68 are provided only on leg 40. Moreover, they are of a length sufficient to substantially fill the interior of a cavity 71 formed within legs 40 and 42 when the implement is in the closed or storage condition. Alternatively, bristles 68 could be shorter in order to accommodate the analogous placement of a second set of bristles on leg 42. That would enable a set of bristles mounted on one leg to be course or stiff and those on the other to be finer or softer.

Figure 8:
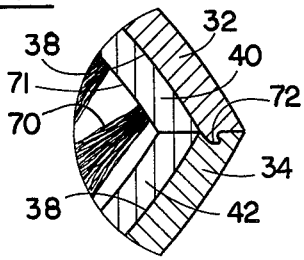
FIG. 8 is a fragmentary enlargement of the area bounded by circle 8 in FIG. 7.

As indicated in FIG. 8, the mating margins of legs 32 and 34 are formed with a combination of a seat and recess at 72, so as to align those margins on closure. That seat and recess are mutually formed to snap together so as to form a latch. Of course, the latch mechanism could be as simple as a rubber band wrapped around the assembly when in the closed condition.

Figure 22:
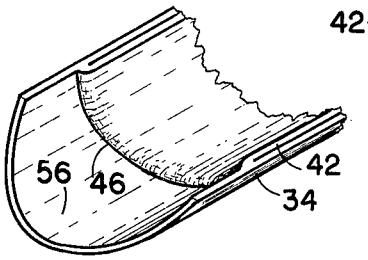
FIG. 22 is a fragmentary isometric view of a hinge with the assembly in a position corresponding to that shown in FIG. 4, except that a flap has been pulled outwardly to allow a clearer view of other components.
Figure 23:
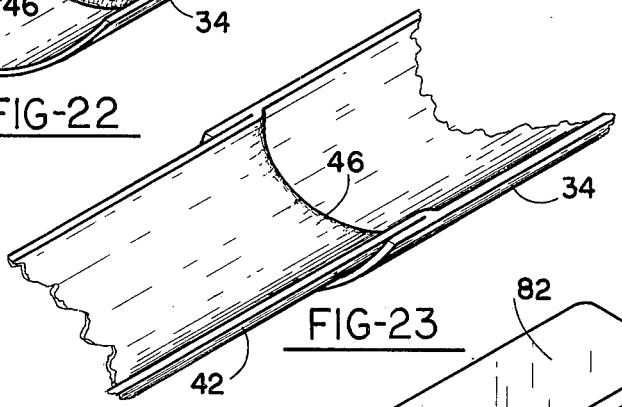
FIG. 23 is a fragmentary isometric view of that same hinge with the assembly in the position of FIG. 17.

The manner in which the different ones of hinges 36, 44, 46 and 48 are formed may take various forms. It is contemplated that all of the parts, except possibly the bristles, would be of molded plastic. It is now well known to mold joining plastic parts in a manner to form a hinge which is integral therewith. That form of hinge has been specifically illustrated at 48 for the joinder of legs 40 and 42. The same approach is used for hinge 36. As shown in FIGS. 22 and 23 for hinge 46, an integrally-formed hinge is preferred for hinges 44 and 46. On the other hand, any or all of the hinges may be formed by heat sealing or ultrasonically bonding a thin strip of flexible plastic material across the hinge line. In any case, the ends of legs 40 and 42 which respectively abut legs 32 and 34 preferably are rounded so as to swing smoothly about what becomes a concave hinge line. In a prototype, all of the different hinges were simply a strip of flexible tape adhesively secured across the hinge line.

Figure 24:
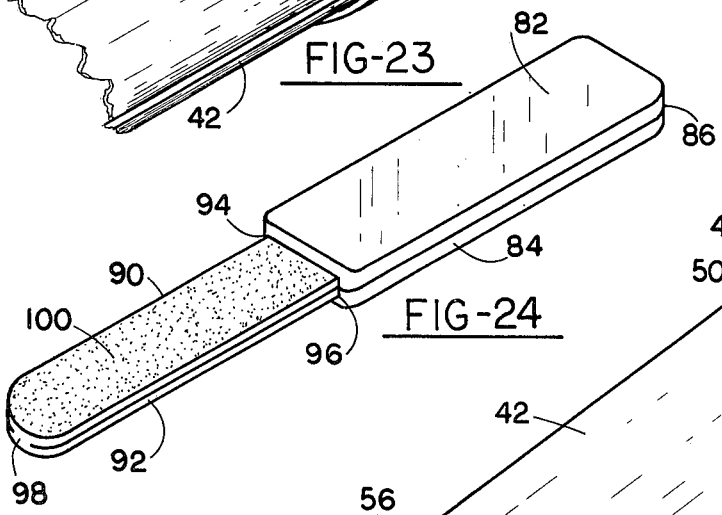
FIG. 24 is an isometric view of an alternative embodiment with the basic parts arranged in a use made in a manner analogous to FIG. 17.

A much simpler embodiment is illustrated in FIG. 24. It includes legs 82 and 84 hinged at 86. Analogous to the use position shown in FIG. 17, legs 90 and 92 project away from the other legs in the use position. Leg 90 is hinged to leg 82 at 94, while leg 92 is hinged to leg 84 at 96. At their other ends, legs 90 and 92 are hinged as indicated at 98. On the exposed surface at least of leg 90, in the use position, is secured an abrasive material 100. Thus, the implement becomes an emery board. Course and fine abrasive action may be provided on the respective two different ones of legs 90 and 92. Not having to accommodate the volume of the brushes as in the earlier embodiment, the implement of FIG. 2 becomes much thinner in overall profile.

In the manner of FIG. 24, a variety of other implements may be formed. The outer ends of legs 90 and 92 may be shaped to form a screwdriver blade. Their lateral margins could define a cutting or scoring edge. As an additional example, blades 90 and 92 might be matingly serrated inwardly from one lateral margin so as to constitute a comb. Chemical or electrical sensing elements may be incorporated into either one of both legs 90 and 92, elements that needed to be protected from the environment or abuse when not in use by being stored within the cavity defined by legs 82 and 84. The suggestion of such alternative adaptations is intended to be merely illustrative.

While particular embodiments of the invention have been described, it will be obvious to those skilled in the art that changes and modifications may be made without departing from the invention in its broader aspects. Therefore, the aim in the appended claims is to cover all such changes and modifications as fall within the true spirit and scope of that which is patentable.

I claim:

1. An implement comprising:

first and second elongated legs joined by a first hinge between respective one ends thereof to permit said legs to be moved toward and away from one another around said hinge, said legs being mutually shaped to define a cavity when folded together about said hinge;

third and fourth elongated legs each of a size to nest within the portion of said cavity defined by a respective one of said first and second legs;

a second hinge coupling one end of said third leg to the other end of said first leg;

a third hinge coupling one end of said fourth leg to the other end of said second leg;

a fourth hinge coupling together the other ends of said third and fourth legs;

said legs individually having respective lengths permitting toggle movement of said third and fourth legs between a first stable position concealed within said cavity and a second position in which they project generally away collinearly from said cavity and said first and second legs when the latter are moved together;

and work means defined on at least one of third and fourth legs for performing a task when they so project away from said cavity.

2. An implement as defined in claim 1 in which, when in said concealed position, said third leg exhibits a shape corresponding to the shape of said first leg and said fourth leg exhibits a shape corresponding to the shape of said second leg.

3. An implement as defined in claim 2 in which, when in said second position, said third leg again exhibits a shape corresponding to said first leg and said fourth leg exhibits a shape corresponding to the shape of said second leg.

4. An implement as defined in claim 2 in which said third and fourth legs each exhibit a concave lateral cross section in each of said first and second positions but in which, during said toggle movement between said first and second positions, said third and fourth legs each flexes about a longitudinal midportion and assumes a reversed mode of concavity.

5. An implement as defined in claim 4 in which said fourth hinge includes a flexible wall defining facing concave hinge lines between said wall and the respective ones of said third and fourth legs, said well exhibiting a concave shape in each of said first and second positions but reversing its mode of concavity during said toggle movement between said positions.

6. An implement as defined in claim 4 in which said work means is a brush composed of an array of bristles secured in at least one of said third and fourth legs and projecting outwardly from the side thereof that faces inwardly when in said first position, said bristles being squeezed together when said legs are in said first position and being spead apart when said legs are in said second position.

7. An implement as defined in claim 4 in which a flap is included on the other end of one of said first and second legs and projects over the other end of the other of said first and second legs when in said first position.

8. An implement as defined in claim 7 in which said flap is of concave configuration when said legs are in each of said first and second positions but in which its mode of concavity is reversed during said toggle movement between said positions.

9. An implement as defined in claim 1 in which a flap is included on the other end of one of said first and second legs and projects over the other end of the other of said first and second legs when in said first position.

10. An implement as defined in claim 1 in which said work means is a brush composed of an array of bristles secured in at least one of said third and fourth legs and projecting outwardly from the side thereof that faces inwardly when in said first position.

11. An implement as defined in claim 1 in which said work means includes an abrasive surface formed on at least one of said third and fourth legs and on the side thereof that faces inwardly when in said first position.

* * * * *